US006167740B1

(12) United States Patent
Lipari et al.

(10) Patent No.: US 6,167,740 B1
(45) **Date of Patent: *Jan. 2, 2001**

(54) METHOD AND APPARATUS FOR FORMING BENDS IN A SELECTED SEQUENCE

(75) Inventors: B. J. Lipari, Evergreen; Roman L. Tankelevich, Lakewood, both of CO (US); Vladimir I. Abliazov, St. Petersburg (RU); Valery A. Li, St. Petersburg (RU); Vyacheslav S. Korolev, St. Petersburg (RU); Victor N. Tisenko, St. Petersburg (RU)

(73) Assignee: Laser Products, Inc., Oak Ridge, TN (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/020,627

(22) Filed: Feb. 9, 1998

Related U.S. Application Data

(63) Continuation of application No. 08/735,034, filed on Oct. 22, 1996, now abandoned.

(51) Int. Cl.[7] ..... B21D 11/00

(52) U.S. Cl. ..... 72/306; 72/307; 72/384; 72/399; 72/446; 72/379.2

(58) Field of Search ..... 72/294, 306, 307, 72/384, 399, 403, 404, 446, 447, 217, 388, 372; 11/379.2

(56) References Cited

U.S. PATENT DOCUMENTS

| | | | | |
|---|---|---|---|---|
| 5,461,893 | * | 10/1995 | Tyler | 72/307 |
| 5,765,426 | * | 6/1998 | Saegusa | 72/311 |
| 5,787,750 | * | 8/1998 | Song | 72/307 |
| 5,852,945 | * | 12/1998 | Burger | 72/306 |
| 5,881,591 | * | 3/1999 | Ondracek | 72/307 |

* cited by examiner

*Primary Examiner*—Ed Tolan
(74) *Attorney, Agent, or Firm*—Sheridan Ross P.C.

(57) ABSTRACT

The present invention relates generally to bending a workpiece to form a desired configuration and, in particular, to a method and apparatus for forming bends "out of sequence," i.e., in a time sequence different from the spatial sequence of the bends on the workpiece. The apparatus of the present invention include a bending system for bending a workpiece and a positioning system for positioning the workpiece relative to a bending region so that bends can be formed in various locations across the bending region. By virtue of the disclosed structures, a series of bends can be formed on a workpiece at various locations within the bending region. Bends can be formed out sequence and without advancing the workpiece relative to the bending region.

27 Claims, 7 Drawing Sheets

METHOD AND APPARATUS FOR FORMING BENDS IN A SELECTED SEQUENCE

This application is a continuation of U.S. Ser. No. 08/735,034, filed Oct. 22, 1996 now abandoned.

FIELD OF THE INVENTION

The present invention relates generally to bending a workpiece to form a desired configuration and, in particular, to a method and apparatus for forming bends either in a sequential manner or "out-of-sequence", i.e., in a time sequence different from the spatial sequence of the bends on the workpiece. The invention is applicable to a variety of malleable materials, including metallic and non-metallic materials, and to various profile types including strips, rods, tubes, pipes, linear or planar workpieces and the like.

BACKGROUND OF THE INVENTION

Many systems for bending workpieces to form a desired configuration have been devised. In such systems, the workpiece is typically driven past a bending station such that the workpiece is formed into the desired configuration beginning at one end and progressing at intervals along the length of the workpiece until the configuration is completed. The bends are thus formed in a time sequence corresponding to the spatial sequence of the bends on the workpiece.

A number of different types of bending tools may be employed at the bending stations of such devices including, for example, brake presses, mandrel and wiper bending tools, and roller arrays, e.g., three or more bending rollers arranged in a pyramid or triangular array. In a brake press, the workpiece is pressed between appropriately shaped dies to form the bend. In mandrel and wiper bending, the wiper is moved so as to cause the workpiece to bend about the mandrel. In roller array systems, at least one of the rollers can ordinarily be moved relative to adjacent rollers so that the curvature of the resulting bend in the workpiece pressed between the rollers can be varied.

SUMMARY OF THE INVENTION

It has been recognized that conventional bending systems do not fully address the needs of certain industrial bending applications. In particular, such conventional systems are generally not adapted for use in forming a variety of workpiece configurations, of either a complex or simple nature, which involve sequential or out-of-sequence bends and/or where workpiece movement is limited, which accommodate a range of workpiece sizes from small to large—requiring mechanical intervention to move, on a variety of workpiece materials.

One such industrial application relates to bending elongate strips of metal to form complicated configurations. For example, in the sign industry, a strip of metal can be bent to form the side wall of a neon tube housing. Because such housings may take the form of a custom design, artwork or letters of various sizes and fonts, the side wall configuration varies dramatically from case to case.

In order to accommodate the demands of such applications, it is preferable that the bending system employed be readily capable of forming bends of a variety of shapes including corners and smooth curves. Moreover, in order to more nearly achieve full automation or operate in limited space, it is desirable that the bending system not only be capable of forming bends in a sequential fashion, but also in an order out of sequence. In this regard, it will be appreciated that some configurations are problematic in that an attempt to sequentially form the configuration bends, i.e., beginning at one end of the workpiece and progressing along the length of the workpiece until the configuration is completed, results in mechanical interference between portions of the workpiece or between the workpiece and the bending machinery. Such interference can often be reduced or eliminated by forming the bends out of sequence.

However, conventional systems generally are not adapted for automatically forming bends either sequentially or out of sequence, regardless of the size of the workpiece. As a result, conventional systems are significantly restricted in the type of final products they can produce. Moreover, in such systems, it may be difficult or impossible to reverse workpiece motion or reposition the workpiece relative to the bending machinery to achieve out-of-sequence bends after a bend has been formed. An inability to do so can preclude utilizing the bending station to process the workpiece at a location upstream from a previously formed bend. Consequently, it is common to form such configurations by manually maneuvering the workpiece to conduct out-of-sequence processing.

The present inventions address these concerns by providing a method and apparatus for automatically forming sequential or out-of-sequence bends on a workpiece. The inventions can be employed for forming bends of a variety of shapes including corners and smooth, continuous curves. Moreover, the inventions can be employed to operate on a stationary workpiece, where advancement of the workpiece during a bending operation is inconvenient or impossible or on a moving workpiece. Similarly, the bending tools may be stationary or may be moving. The inventions can also be employed in conjunction with a controller for deriving bending information to achieve substantially full automation or to maintain workpiece registration for increased accuracy in bending.

The apparatus of the present inventions include a bending system for bending a workpiece and a positioning system for relative positioning of the workpiece and the bending system so that bends can be formed in various locations within a defined bending region. By virtue of this structure, a series of bends can be formed on the workpiece at various locations within the bending region and in an appropriate sequence to avoid interference.

The bending machine utilizes a double gantry system for manipulating the bending tools and the workpiece relative to each other. The apparatus includes a first bending element associated with a first positioning assembly such that the first bending element can be positioned relative to two separate axes. There is also a second bending element associated with a second positioning assembly such that the second bending element can also be positioned relative to the two axes. The first and second positioning assemblies are preferably independently operable to provide relative movement between the first and second bending elements during a bending operation.

In this embodiment, the first positioning assembly is preferably on a first gantry and the second positioning assembly is preferably on a second gantry. Each of the bending elements can include one or more bending rollers or forming tools, a mandrel and/or a clamp. A corner or angle of any degree can be formed in the workpiece by clamping the workpiece and then moving a bending roller or other wiping mechanism across the workpiece so that the workpiece is bent about the clamp. A curve can be formed by causing relative movement of the workpiece and a bending or forming element. The bending element may be either one, two or three rollers, disposed along the path of movement. This is accomplished by moving the bending element(s) while holding the workpiece stationary, by holding the bending element(s) in a selected stationary orientation and then driving the workpiece into contact with the bending element(s), or by simultaneous movement(s) of both. The double gantry apparatus thereby provides significant flexibility in forming various shapes of bends on a moving or stationary workpiece and for forming such bends substantially or fully automatically and in a predetermined sequence.

The bending apparatus also can be employed in conjunction with a controller for providing information regarding the bends. The controller receives design information regarding the desired workpiece configuration and derives bending information based on the received design information. The bending information can include information regarding the shapes and positions of bends for forming the desired configuration and/or information regarding a sequence for forming the bends. The derived bend information can be employed by the positioning system of the apparatus to provide substantially fully automatic bending without interference between the workpiece and itself or with the bending tools. An indexing system may be simultaneously employed to maintain registration of the workpiece relative to the bending elements to maintain full automation and bending accuracy. It should also be readily understood that such equipment is optional.

The bending table apparatus can also be used in conjunction with a preforming or input processing system in which stock metal coil is preformed with a base flange which is further notched to accommodate intended bends. The stock material may also be subjected to creasing to further facilitate bending and particularized bending instructions can be affixed to the stock material to enhance automation. The stock material may be cut to appropriate lengths consistent with the desired end product. In this regard, it will also be appreciated that, depending upon the size of the end product, it may be desirable to splice multiple workpieces together rather than work with a single, cumbersome workpiece. The preforming system may further include a clamp or mandrel for bending the workpiece and a workpiece advancing mechanism for advancing or positioning the workpiece relative to the bending elements.

According to another aspect of the present invention, a method for forming out of sequence bends in a workpiece is provided. The method includes the steps of determining a sequence of bends for forming a workpiece into a desired design, positioning the workpiece in a bending region, providing a bending tool which is positionable relative to the bending region by operating a positioning system, forming a first bend by operating the positioning mechanism to position a bending tool at a first location of the bending region, forming a second bend by operating the positioning mechanism to position the bending tool at a second location of the bending region, and holding at least a portion of the workpiece fixed from a first time of forming the first bend to a second time of forming the second bend.

Further, the positioning system can be operated to form a series of bends out of sequence. For example, for a series of three bends, including a first bend, a second bend and a third bend, where the second bend is physically located between the first and third bends, the positioning system can be operated to form the second bend at a time which is not chronologically between the times when the first and third bends are formed. The method of the present invention allows for formation of the bends in a sequence which reduces or eliminates mechanical interference. Such a sequence can be determined by employing a controller which is capable of determining an optimal series for the bends.

The invention also includes a method for operating a bending machine for bending a workpiece to form a desired design, whereby a process for assuring conformity to selected design criteria is greatly simplified. The method includes the steps of determining a completed shape of a desired design that includes a plurality of bends, selecting design criteria concerning the process for bending the workpiece to form the desired design, analyzing a potential operation for straightening one of the bends of the design relative to the selected design criteria, repeating the step of analyzing to derive a backwards sequence for forming a straightened workpiece beginning from the desired final design, reversing the backwards sequence thereby to obtain a forward sequence for forming the workpiece into the desired design in accordance with the design criteria, and operating the bending machine to form the bends in the workpiece in the forward sequence. The bending criteria may involve avoiding mechanical interference between separate portions of the workpiece, maintaining the workpiece within a defined bending region of the bending machine, advancing the workpiece through a specific location of the bending machine (e.g., a clamp or advancement rollers), minimum time and/or power for completing the bends or other desired criteria.

Upon a review of the following detailed description and drawings, it will be readily apparent to those having skill in the art, that the inventions herein have a broad range of applications beyond the sign industry, including but not limited to forming glass tubing, or forming enclosures. The present inventions are capable of any application requiring precise movement and positioning of tools, including lasers, routers, cutters, welders, printers and the like.

BRIEF DESCRIPTION OF THE DRAWINGS

For a more complete understanding of the present invention and further advantages thereof, reference is now made to the following detailed description, taken in conjunction with the drawings in which.

It should be understood that the drawings are not necessarily to scale. In certain instances, details which are necessary for an understanding of the present invention or which render other details difficult to perceive may have been omitted. It should be also understood, of course, that the invention is not necessarily limited to the particular embodiments illustrated herein.

DETAILED DESCRIPTION OF THE PREFERRED EMBODIMENT

The present invention is directed to a method and apparatus for bending a workpiece to form a desired shape and is useful in a variety of bending applications involving various materials and profile types. In the following description, the invention is set forth with respect to three specific applications for bending sheet metal to form a side panel of a three dimensional housing. Such housings are common in the sign industry for use in constructing neon lighted channel letters or other designs.

Figure 1:
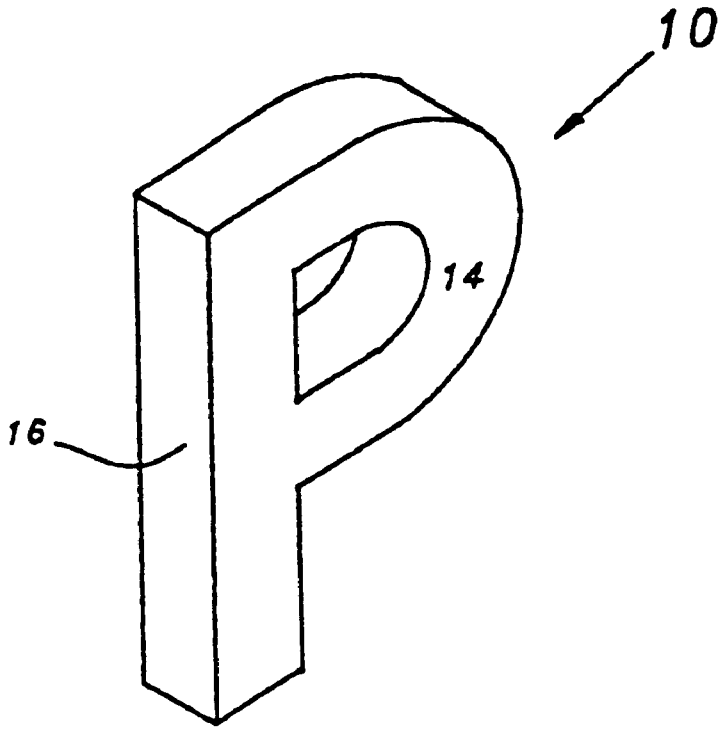
FIG. 1 is a perspective view of a channel letter constructed in accordance with the present invention.
Figure 2:
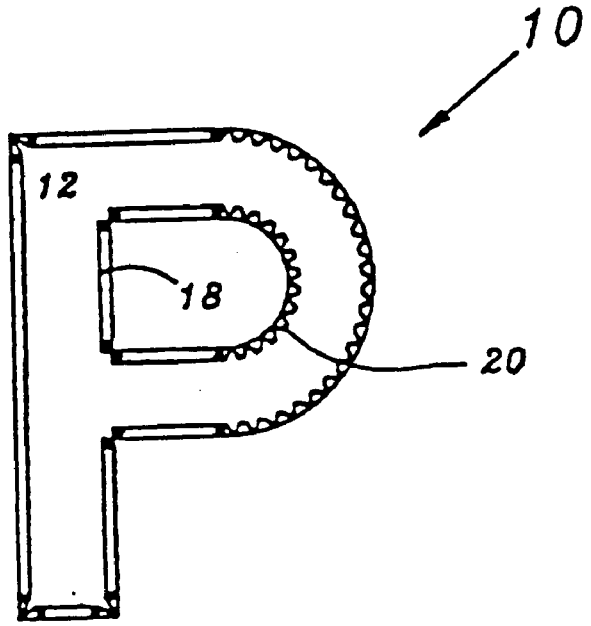
FIG. 2 is a bottom plan view of the channel letter of FIG. 1.
Figures 3A, 3B:
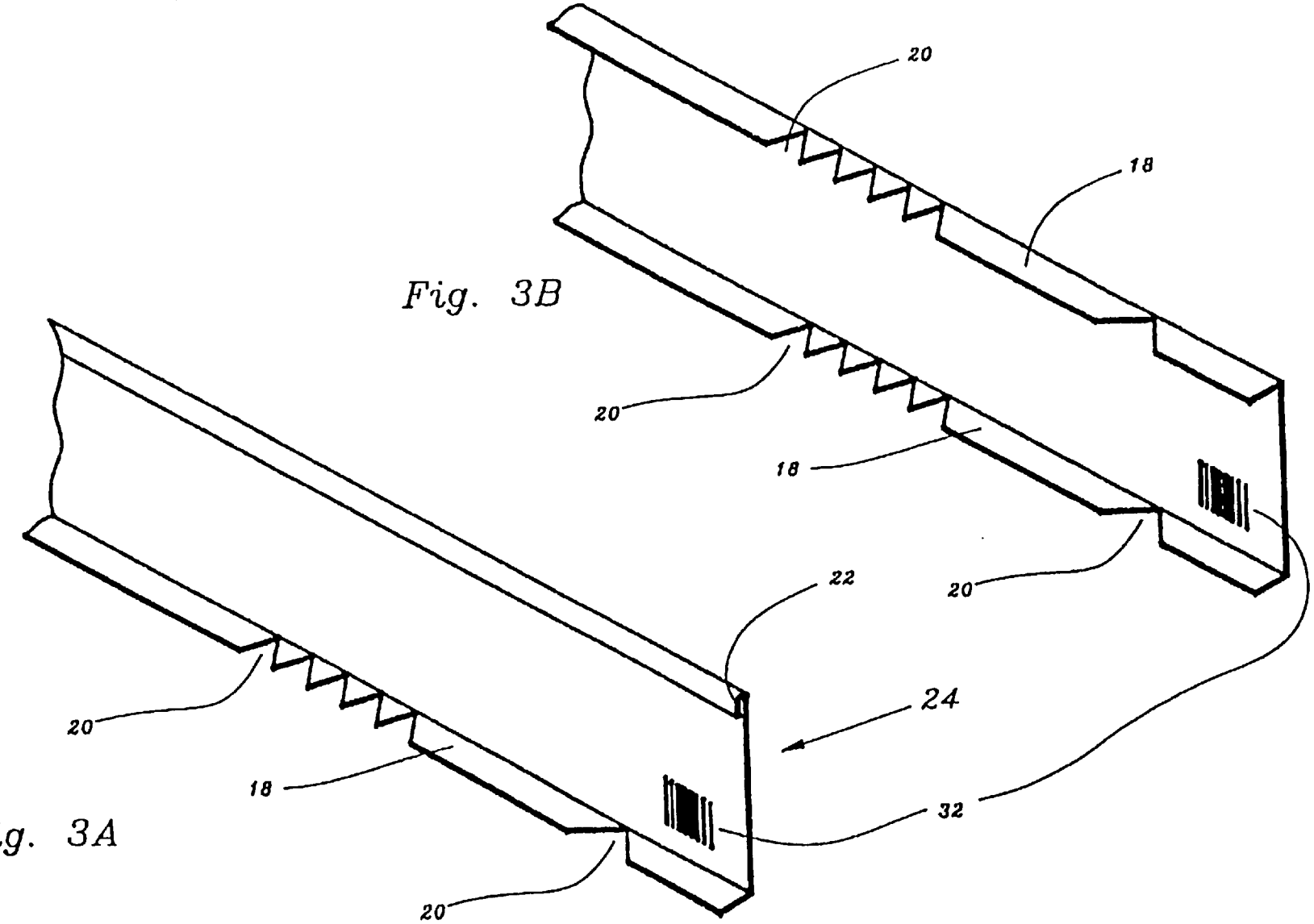
FIG. 3A is a perspective view of a portion of a preformed workpiece used to form the channel of the channel letter of FIG. 1.
FIG. 3B is a perspective view of a portion of a different preformed workpiece used to form an enclosure.

A channel letter 10 constructed in accordance with the present invention is shown in FIGS. 1 and 2. Generally, the channel letter 10 includes a flat letter-shaped back plate 12, a translucent or transparent front plate 14, and a side panel or channel 16. The channel 16 includes a flange 18 for interconnection to the back plate 12 using pins, rivets or the like. The flange 18 may have notches 20 to facilitate bending. A hem 22 (FIG. 3A) may also be formed on the channel 16 for use in attachment of the front plate 14. Alternatively, as seen in FIG. 3B, a second flange 18 may be formed on the opposite edge of the workpiece, and would include notches 20 matching those formed in the opposite flange 18.

A workpiece 24 that can be used in accordance with the present invention to form the channel 16 is shown in FIG. 3. The processes and apparatus for pre-forming the channel 16 are set forth in related U.S. Pat. Nos. 5,377,516 and 5,456,099 which are hereby incorporated by reference. As shown, the pre-formed channel 16 includes a flange 18 and a hem 22.

The illustrated bending machine 30 is scalable in size to work with a large range of workpieces, in both size and material type. The preferred embodiment, intended for use in connection with neon signs, is designed to operate on aluminum, copper-based, stainless steel or steel workpieces. The typical thickness of the workpiece 24, used in connection with neon signs, will vary from about 0.4 millimeters to about 3 millimeters depending on the material and the application. The typical width of the workpiece 24 will vary from about 5 centimeters to about 30 centimeters, although other material thicknesses and widths can be accommodated with appropriate modifications to the machinery.

The bending machine of the present invention may be integrated or implemented in line with the pre-forming tools described in the above-referenced related applications, or may be separate. The illustrated workpiece 24 includes encoded or machine-readable indicia 32, such as a bar code, which can be used for inventory purposes and/or to access a file of bending information setting forth, for example, the shape, size, sequence of bends and other information for use in bending the workpiece 24 to form the desired design.

Figure 4:
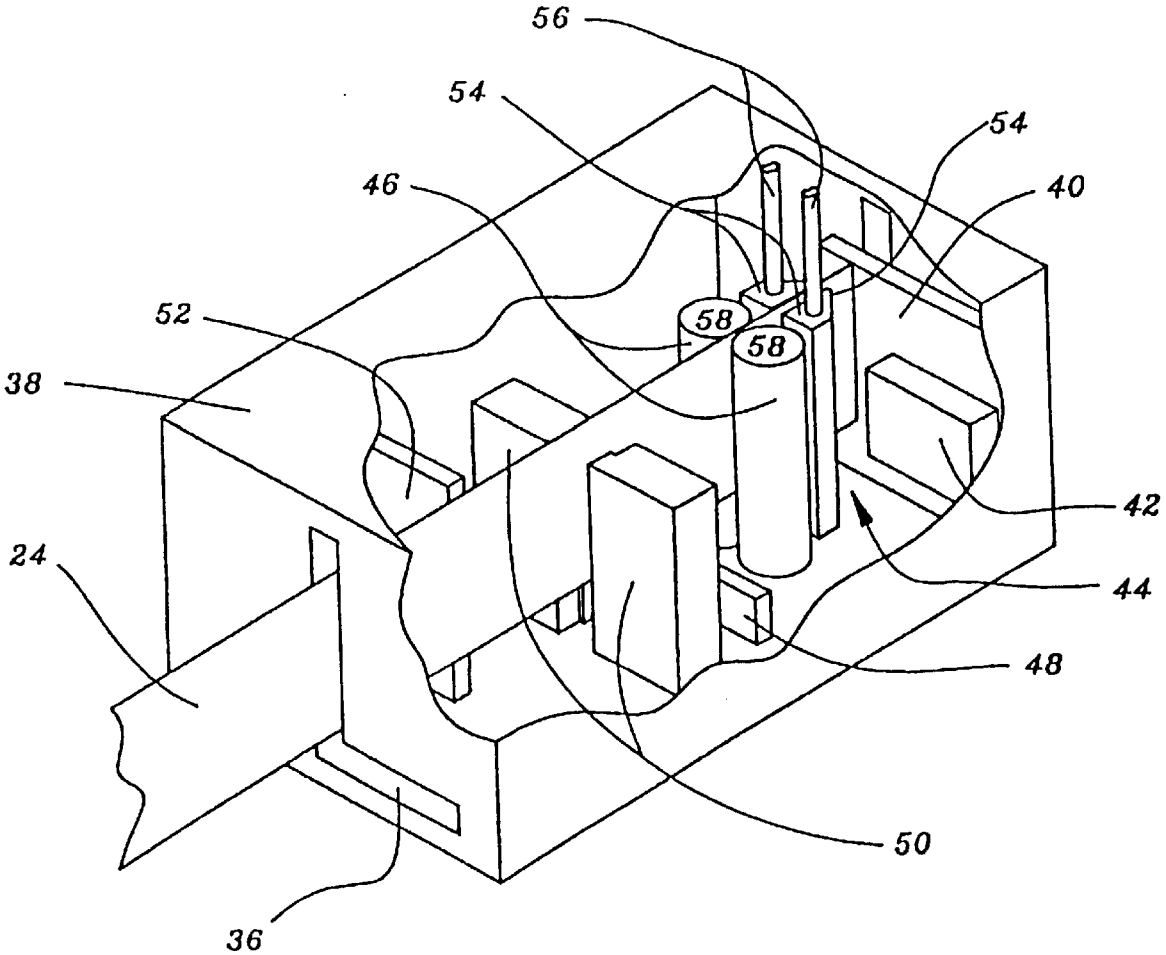
FIG. 4 is a perspective view, partially cut away, of one embodiment of the input processing module of the present invention.
Figure 5:
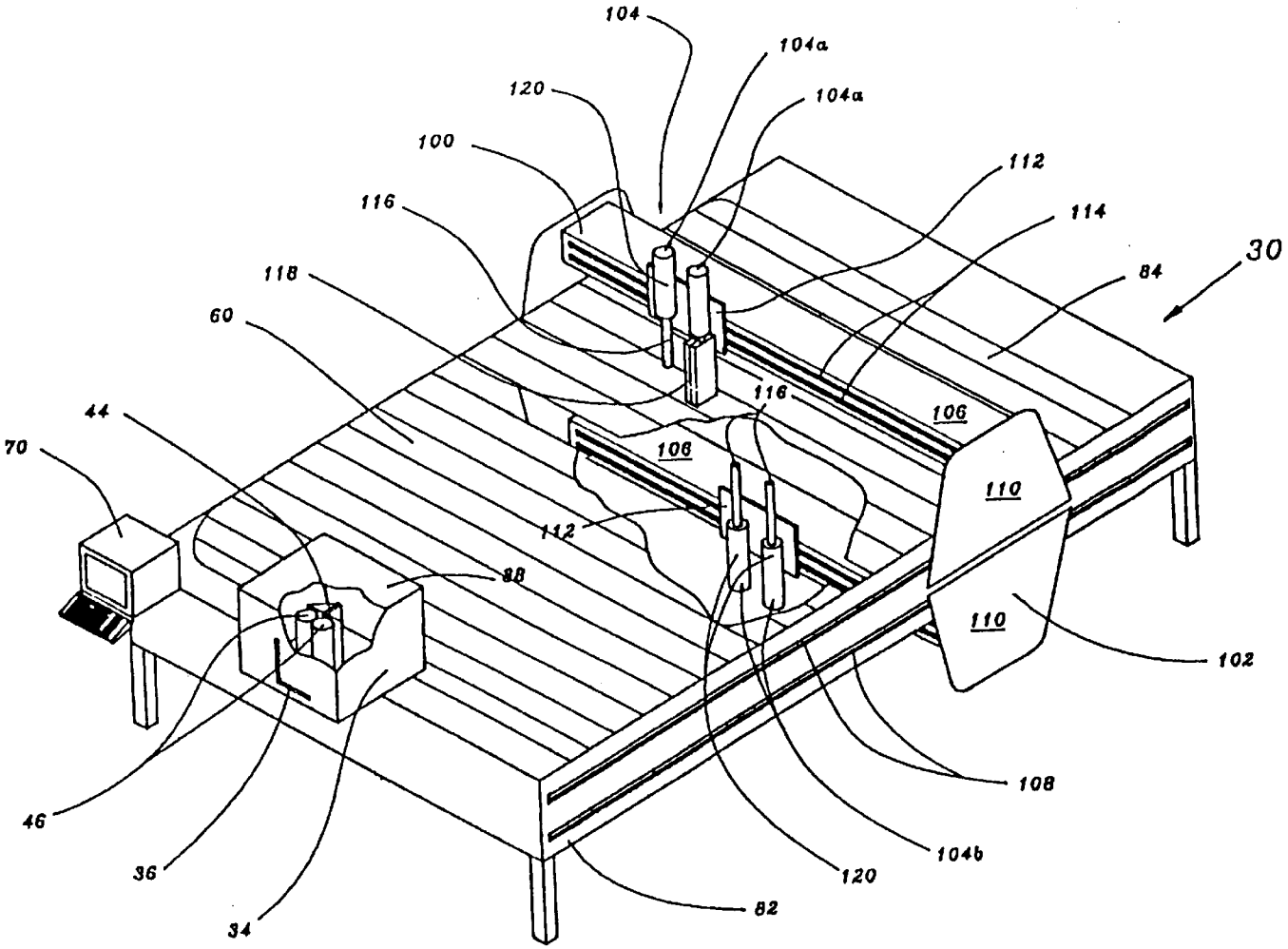
FIG. 5 is a perspective view, partially cut away, showing the double gantry bending machine embodiment of the present invention.

Referring to FIG. 5, the bending machine of the present invention is generally identified by the referenced numeral 30. Generally, the bending machine incorporates a preforming system or input processing module (IPM) 34 in one form or another. One embodiment of the IPM is shown in greater detail in FIG. 4.

The function of the IPM 34 varies depending upon the capabilities of the bending machine 30. For example, the IPM 34 may include precreasers or notching devices to facilitate ultimate bending of the workpiece, cutting devices to cut the stock material to desired lengths, offset dies to form offsets in the workpiece for fastening end portions together, and indexing or registering systems to accurately identify the location of the workpiece relative to the bending tools for generating precise and accurate bends. The IPM 34 is shown as a separate component in FIG. 4 and, for example, could include a precreaser, clamps, notching devices and offset dies, other appropriate preforming equipment or any combination thereof. Alternative embodiments and other variations or configurations deemed to be within the scope of Applicants' inventions will be understood to persons of skill in the art.

With reference to FIG. 5, the IPM 34 extends a small distance into the gantry type bending table working area, in the illustrated embodiment approximately six inches. For ease of construction and assembly, the IPM 34 may be constructed and transported separate from the bending machine 30 and then assembled on-site. In this regard, indexing pins or the like (not shown) may be provided to insure accurate registration.

In FIG. 4, the initial insertion of the workpiece 24 into the IPM 34 may be manual or it can also have an automatic input feed from a coil of stock material or a preformer apparatus (not shown). In this regard, the workpiece 24 is introduced into the IPM 34 through a conformal slot 36 formed in the housing 38 of the IPM 34. The conformed slot 36 may be modified and oriented in any fashion to accommodate workpieces 24 of varying cross sections. The workpiece 24 is progressively inserted through the conformal slot 36 until an end of the workpiece 24 reaches a stop 40. The stop 40 insures appropriate longitudinal positioning of the workpiece 24. In addition, the stop 40 is equipped with a sensor 42 which confirms correct loading of the workpiece and triggers various functions as will be set forth below. The sensor 42 may be, for example, an optical or electrical contact sensor, an inductive or magnetic sensor, or any other suitable sensor element.

The illustrated IPM 34 in FIG. 4 includes a clamping device 44, an advancement assembly 46, a sensor or scanner 48, a die assembly 50 and shears 52. The clamping device 44 includes a pair of jaw members 54 mounted to pivot on shafts 56 between open and closed positions to selectively disengage and engage the workpiece 24. If the jaws 54 or clamping device 44 is to assist in bending the workpiece, it may be repositioned from what is depicted in FIG. 4, to the final piece of equipment in the IPM 34 to cooperate in forming sharp angles or corners.

The advancement assembly 46 preferably includes at least a pair of motor-driven rollers 58 that engage the workpiece 24 so as to advance the workpiece 24 into the working area 60 of the bending machine 30 as will be described in more detail below. Of course, it should also be understood that the workpiece can be advanced by robotic arms, tractor feeds, escapement mechanism or in any other manner known within the art.

The rollers 58 can be of varying sizes, although a diameter of approximately two inches appears most suitable for the stock material involved here. The external surface of the roller may be urethane, rubber, or other material suitable for securely manipulating the workpiece without slippage. The rollers 58 are also laterally adjustable to accommodate loading of a workpiece 24 and workpieces of varying thickness'. The sensor or scanner 48 is positioned to read the machine readable indicia 32 (FIG. 3) on the workpiece 24 and may be inductive, magnetic, optical or other type of sensing apparatus. This information is then reported to the controller 70. A die assembly 50 is optionally used to form offset flanges in the workpiece for joining separate ends thereby resulting in a smooth walled final product. A further optional piece of equipment is a scribe (not shown) to form creases across the workpiece 24 at predetermined bending locations (i.e., at the notches 20 in the flange 18) to facilitate bending and improve longitudinal bending location accuracy. The shears 52 are used to cut the workpiece 24 to a desired length when the workpiece 24 is provided from a coil or the like or when bending is facilitated by utilizing smaller workpieces.

When the sensor 42 senses that the workpiece 24 has contacted the stop 40, the resulting signal triggers the clamping device 44 to engage the workpiece 24. The advancement assembly 46 may or may not have advanced the workpiece 24 against the stop 40. If not, the advancement assembly 46 engages the workpiece 24. Additional rollers or guides may also engage the workpiece 24 at this time in order to ensure proper vertical and longitudinal alignment. The sensor 42 also serves to signal the controller 70 thereby enabling the "start" command for workpiece 24 processing to begin, in a totally automated environment. If an indexing system is employed, a known point of reference or origin is defined to allow calculation of all subsequent workpiece positions. The origin may be in close proximity to the optical scanner 48, or may be any other known point such as the forward tip of the clamping device 44.

In summary, the IPM 34 is capable of performing the following operations. The conformal input slot 36 allows the bending machine 30 to accept material that is correctly flanged. The stop 40 and sensor 42 indicate correct and complete engagement of the workpiece 24 into the bending machine 30. The sensor 42 confirms correct loading of the workpiece 24 and triggers engagement of the clamping device 44 and advancement assembly 46, as well as triggering the software to initiate processing. In addition, the clamping device 44 clamps and releases the workpiece 24 as required for processing and may also define a home position or origin for calibrating all mechanical tooling positions and moves. This origin may be coincident with the edge position of the workpiece 24 upon successful loading or a scanable indicia printed on the workpiece 24. The advancement assembly 46 is operable to move the workpiece 24 through the clamping device 44 and control the rate of movement including acceleration, deceleration, feed speed and secure stopping. In this regard, the illustrated bending machine 30 allows for feed speeds up to 7.6 meters per minute. The optional scribe is capable of forming a vertical crease across the workpiece 24 width (the workpiece 24 being inserted edgewise, flange up or down or in some other orientation depending upon the orientation of the bending table) and is adjustable to accommodate various material thicknesses in response to software inputs. The optical scanner 48 reads the indicia 32 for inventory and workpiece processing purposes. Finally, the shears 52 are operable to cut the workpiece 24 to length when required.

It should be further understood that the present invention is capable of forming final designs of vastly varying sizes and shapes. Accordingly, while it is contemplated that a complete design will be fashioned from a single workpiece, it is also contemplated that a final design may be assembled from multiple workpieces which comprise a portion of the final design. Such circumstances include final designs which are physically large in size or which have an overall complex shape.

The following is a detailed description of a particular embodiment of the bending machine of the present invention. The embodiment is intended to be illustrative of Applicants' inventions, rather than a limitation on the manner of practicing the inventions.

Referring to FIG. 5, a perspective view of a dual gantry bending machine 30 is shown. The bending machine 30 comprises an upper gantry 100 and a lower gantry 102 mounted for lateral and transverse horizontal movement of the tools within a work area 60 defined by the table 82 and a moving work surface 84 which assists in supporting the workpiece 24. Each of the gantries 100, 102 carries at least one tool bending assembly 104 as will be described below. The upper and lower tool bending assemblies 104*a*, 104*b*, respectively, cooperate with each other and with the input processing module to form bends in the workpiece 24 at any location within the bending area of the work surface 84. An opening in the moving work surface 84 allows the tool bending assemblies 104 to extend through the moving work surface 84 into the work area 60 to engage the workpiece 24.

The longitudinal and transverse operation of the upper gantry 100 and lower gantry 102 are substantially identical. Each of the gantries comprises a bridge member 106 that is slidably mounted on guide rails 108 at each of its ends 110. The bridge member 106 may be driven along the guide rails 108 by co-driven ball screw actuators located at each end 110 of the bridge member 106 (not shown), or by other means known in the art, such as by a direct drive timing belt. The actuators at the two ends 110 of the bridge member 106 may, in turn, be co-driven by a hydraulic motor (not shown) in response to signals from the controller 70. The motors for moving each gantry 100, 102 may be positioned within the gantry itself, or within the body of the table 82. Longitudinal movement of either or both gantries 100, 102 may create contact between one or more of the tool bending assemblies 104*a*, 104*b* and the moving work surface 84, as desired, which results in bi-directional movement of the moving work surface as needed to allow the bending tools access to the workpiece 24 at any desired location.

Each bridge member 106 carries at least one bending tool assembly 104 which is affixed to a mounting bracket 112 which slides along a bridge guide rail 114 for transverse movement relative to the surface 84 of the table. Movement of the bending tool assembly 104 along the bridge guide rail 114 may be controlled by a hydraulic motor in cooperation with a ball screw actuator (not shown) in response to signals from the controller 70, or by other means known in the art.

Figure 6:
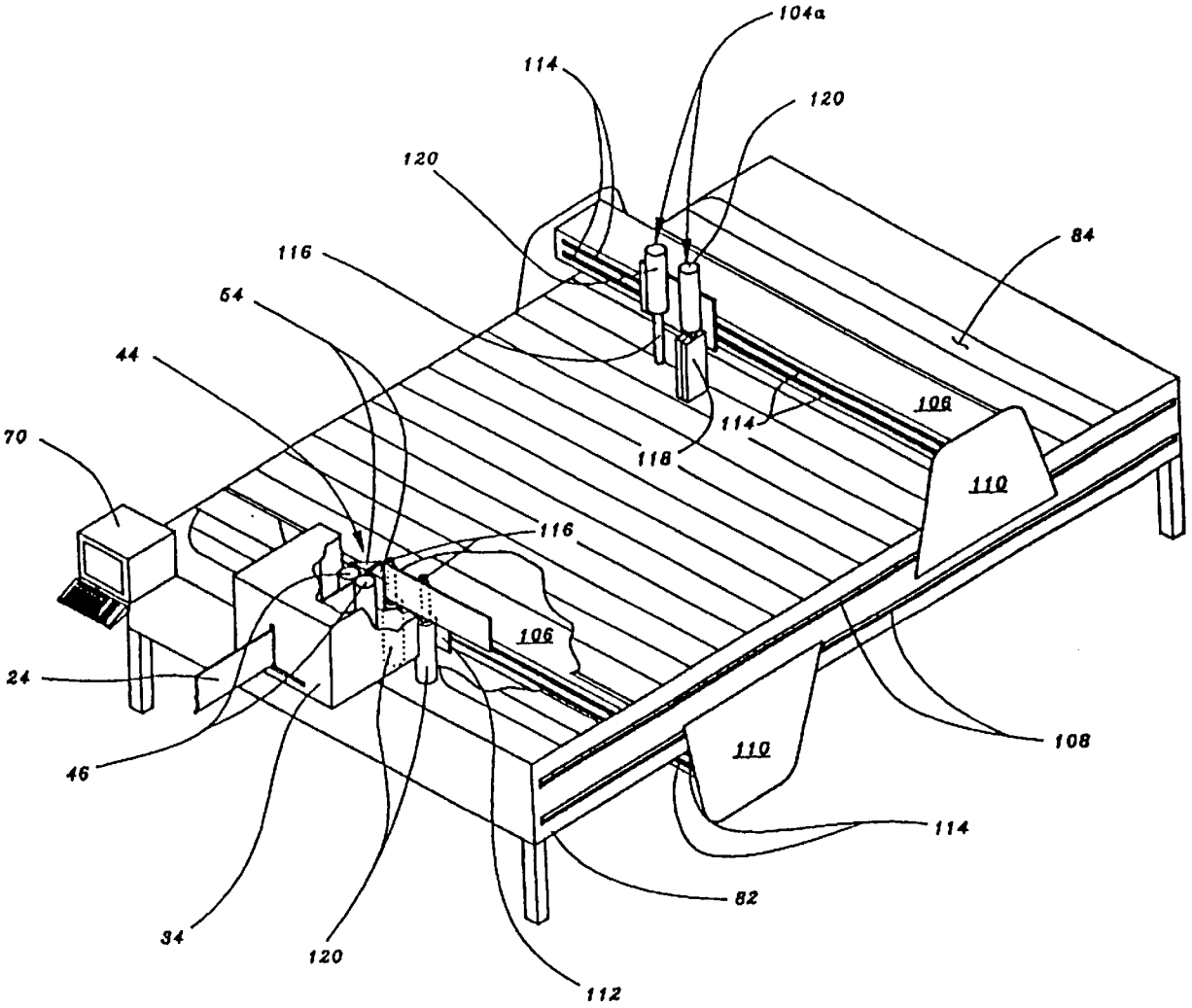
FIG. 6 is a perspective view, partially cut away, showing an angle bend being formed in a workpiece by the by the input processing module and lower gantry of the double gantry bending machine embodiment of the present invention.
Figure 7:
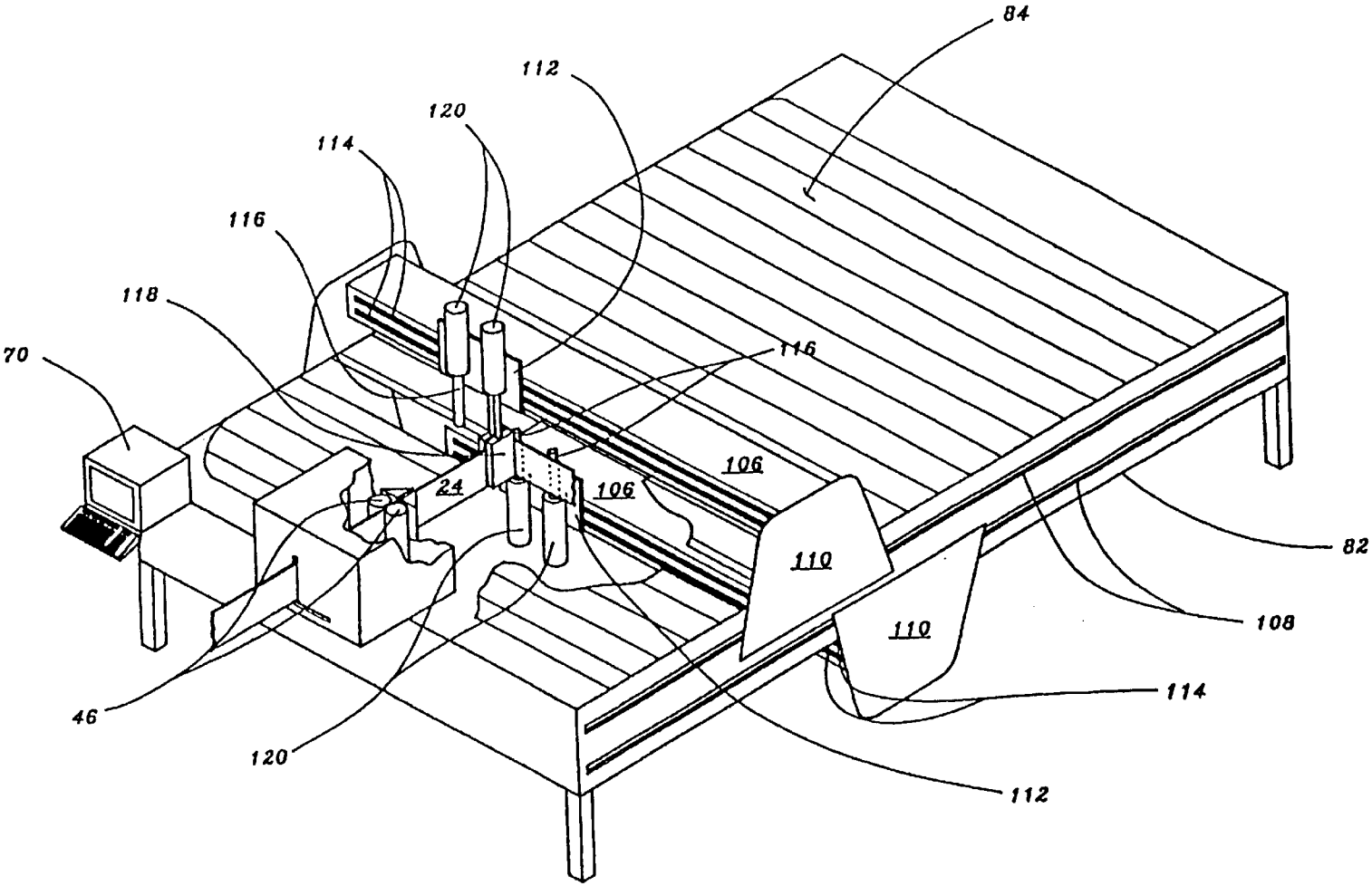
FIG. 7 is a perspective view, partially cut away, showing an angle bend being formed in a workpiece by the by the upper and lower gantries of the double gantry bending machine embodiment of the present invention.

It will be readily appreciated that each gantry 100, 102 may support multiple tool assemblies 104 of varying configurations. For example, in FIG. 5, the upper gantry has two tool assemblies 104*a* affixed to the mount 112 and one tool assembly shows a single tool 116 and the other tool assembly shows a pair of clamps 118, both vertically aligned toward the work area 60. In contrast, the tool assemblies 104*b* mounted to the lower gantry 102 have a pair of bending tools 116 vertically aligned with the work area 60. The embodiments of FIGS. 6 and 7 show the same sets of tools, mounted in the same orientation. However, it should be appreciated that any different orientation or configurations of bending equipment may be satisfactory. In addition, one or both of the gantries may also include a pair of drive rollers, independently positionable relative to the bending tools, for repositioning of the workpiece after a bend is created.

As shown in FIGS. 5–7, the bending tools 116 and clamping tools 118, as well as any other equipment mounted on either gantry 100, 102, is vertically positionable into and out of the work area 60. Actuators 120 raise and lower the bending tools 116 and clamping tools 118 to avoid interference with the workpiece 24 and to position the equipment for bending. In addition, the vertical adjustability accommodates workpieces 24 of different heights. In the case of a flanged workpiece 24, the tools are positioned to accommodate the flange 18.

With a workpiece as shown in FIG. 3A, the flange 18 is disposed at the bottom of the workpiece 24. Thus, the bending equipment positioned on the upper gantry 100 may work on either side of the workpiece, while the bending equipment positioned on the lower gantry 102 may only operate on the non flanged side of the workpiece 24. In the case of a doubled flanged workpiece, FIG. 3B, at least one of the sets of bending equipment will need to be recessed to accommodate one of the flanges to allow for bending.

With the present invention, virtually any desired bend can be formed at virtually any location within the working area 60. For example, as shown in FIG. 6, an angled bend can be formed in the workpiece by utilizing a combination of a bending tool 116 mounted on the lower gantry 102 and the clamping device 44 of the IPM 34. More specifically, while the jaws 54 securely hold the workpiece 24, the lower gantry 102 is positioned to allow the bending tool 116 and its mount 112 to slide laterally along guide rails 114 to form the desired bend. Alternatively, the same type of bend may be formed at a location remote from the IPM 34, as is shown in FIG. 7. That is, the clamping tools 118 disposed on the upper gantry 100 are vertically positioned by actuators 120 to clamp the workpiece 24 in a stationary position while the bending tools 118 mounted to the lower gantry 102 are positioned to create the same type of bend.

Figure 8:
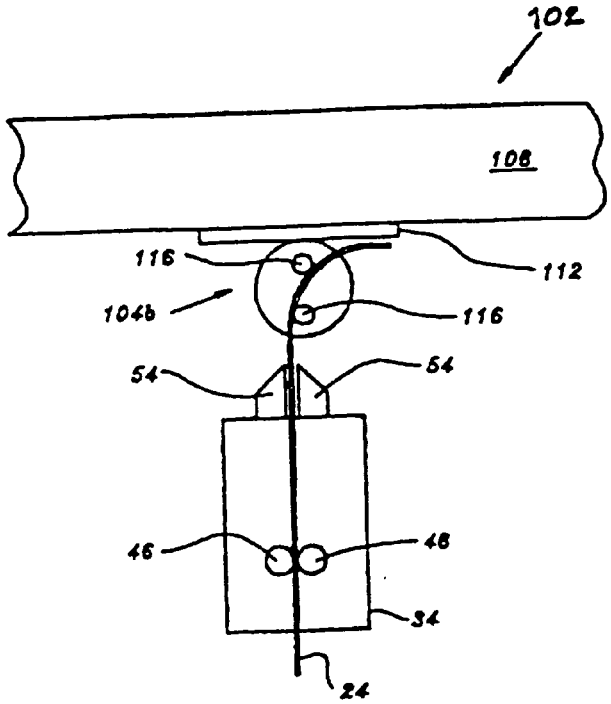
FIG. 8 is a partial top plan view of the input processing module and lower gantry forming a curve in a workpiece.

Further still, the bending tool assembly 104 may be positioned to impart a curve to the workpiece as shown in FIG. 8. FIG. 8 depicts the IPM 34 and a portion of the lower gantry 102. The bending tool assembly 104 includes a pair of bending tools 116 mounted to the bridge 106 by a mounting bracket 112. The entire bending tool assembly 104 is rotatable by means of an actuator motor (not shown). As illustrated, the bending tools 116 are positioned on opposite sides of the workpiece 24. The jaws 54 release the workpiece while the advancement assembly 46 advances the workpiece through the bending tools 116. The bending tool 116 at the inside of the curve acts as a fulcrum while the bending tool 116 at the outside of the curve acts to deflect the workpiece. Alternatively, the workpiece 24 my be held stationary while the gantry is moved, or relative movement of the bending tools and workpiece will create the desired curve.

Figure 9:
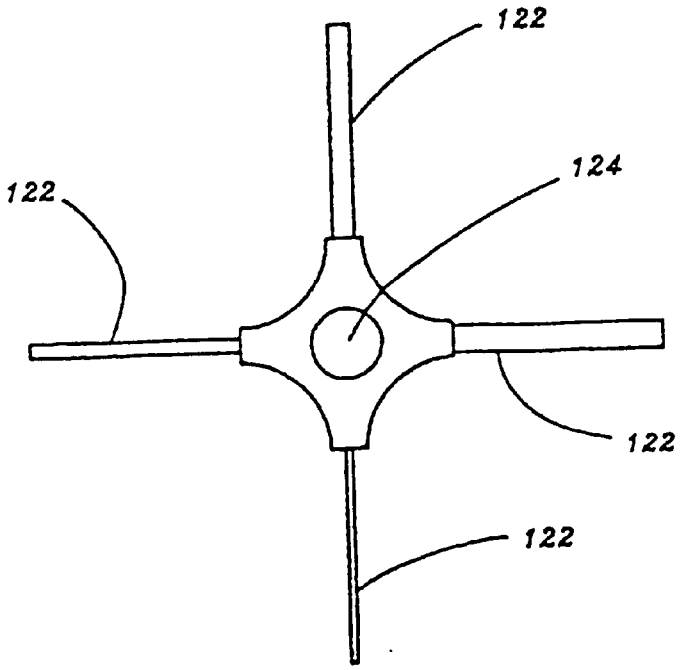
FIG. 9 is an elevated plan view of an alternative bending tool assembly.

It should also be appreciated that creating a curve as shown in FIG. 9 can be equally accomplished using the upper gantry 100. In addition, the pair of bending tools 116 can be caused to move forward and away from each other, by means such as lateral actuators. Such relative movement of the bending tools, provides greater flexibility to the bending apparatus 30.

While FIGS. 5–7 shows a single tool associated with each actuator 98, FIG. 9 depicts an alternative embodiment of bending tool assemblies 104. An assembly 104 may carry multiple tools 116 of different diameters or for different functions. The diameter of a tool determines the minimum radius of curvature for that bending operation. Depending on the bending operation involved, each of the tools 116 may be of the rotatable or non-rotatable variety. It will be appreciated that a rotatable tool is useful for bending without imparting any substantial longitudinal stress to the workpiece 24. In the illustrated embodiment, the diameters of the four tools 116 may vary, for example, from approximately 16 millimeters to 32 millimeters.

In the depicted embodiment, the tools 116 are oriented 90 degrees apart and are rotatably mounted on a shaft 124. Tool selection is thereby accomplished by appropriate rotation of the shaft 124. Shaft 124 rotation is driven by a hydraulic motor (not shown) in response to inputs in the controller 70.

Operation of the bending machine 30 is controlled by the controller 70. The controller 70 may receive design information from a sensor positioned within the IPM 34 or elsewhere. The controller may also receive feedback information from the stop sensor 40, advancing assembly 46 and/or a vision sensing system 42. The controller 70 determines the bending process based on the input information and certain bending criteria, and operates the various machine components in response to the determined bending process.

The input design information may be directly entered by an operator or may be determined based on the bar code or other identifying indicia 32. The input provides sufficient information to allow the controller 70 to determine the shapes, positions and sequence of the required bends. This information may include the stock material, the thickness of the stock, a description of the design, and information regarding the size of the design. For example, where a channel 18 of a letter housing is to be formed, the operator may enter information including the particular letter to be formed, the print style, script or font of the letter, and the size of the letter through a computer keyboard. Of course, this information may also be stored on a computer file and accessed by the controller 70 based upon a sensed input signal from the indicia 32.

As is well known, the material and its thickness may affect the total length necessary to form a shape due to compression and extension forces exerted on the metal during bending. In addition, the manner in which the stock material is stored, i.e., in coils where the inner material is subject to different stresses because it is wound tighter than the outer material, its age, the storage conditions, such as temperature, and the environmental conditions during bending, can directly effect the ability of the material to accurately form and hold a bend. This type of information, necessary for adopting the bending process, may also be stored in a computer file and readily accessed. The controller 70 may also determine that the selected sheet metal is unsuitable for the desired design.

It will be appreciated that dimensional information pertaining to commonly used print styles, scripts and fonts or customized formats can also be stored in computer files for ease of use. Alternatively, measurements may be taken directly, for example, from a front plate 14 of a housing to which the channel 16 is to be fitted. Additionally, the controller 70 may obtain dimensional information for the desired design by reading external files from an external computer-aided design system or machine tool program. Pattern information such as this, when stored in computer files, may be easily retrieved and used in creating bends, in checking the accuracy and location of bends, or in calculating the location or sequence of bends.

The controller 70 may also receive input from an indexing or workpiece registration system, such as an optical scanner 48, for workpiece position detection. The position feedback to the controller 70 allows for adaptive processing of the bending operation. Adaptive processing allows for more accurate location and formation of the bends. In this regard, it will be appreciated that many factors, such as errors in locating previous bends, inherent material characteristics, environmental conditions and material springback may cause the actual workpiece position to vary slightly from the expected position. The position feedback associated with the indexing system prevents accumulation of errors and allows for correction of errors over a series of bends. Depending upon the manner of implementation, the controller may adapt for a positioning error, or an error due to changes in material characteristics, by recalculating the formation of a subsequent bend following the detection of an error, an adjustment in the velocity or positioning of the workpiece 24, bending tools or both, a post bending analysis, or may simultaneously form a bend while recalculating all subsequent processing for dynamic adaptive processing. While adaptive processing and indexing is optional, one situation where it is desired is in forming a bend in the workpiece at a location on the table 82 remote from the position where the workpiece is secured, such as with the clamping device 44 of the IPM 34. This remote bend may be an out of sequence bend required to avoid workpiece 24 interference. For whatever reason, the bending equipment must be accurately positionable to form the bend in the correct location, aligned with preformed notches. Adaptive processing and indexing allows for this.

The controller 70 then utilizes the design input to calculate position and shape information of bends for bending the sheet metal to form the desired design. In calculating the position and shape information, the input design information may be converted onto a standard industrial format for describing designs such as letters or other geometric shapes. Generally these standard industrial formats are used to approximate the design in terms of a series of line and/or arc segments which collectively define an outline or perimeter of the design. For example, the design may be converted into the E.I.A. format, which is commonly used in the machine tool industry for driving computer numeric controller machinery, such as milling machines and the like. Other examples of standard industrial formats include the Gerber format which is commonly used in the electronics industry, and the Hewlett Packard graphics language. The format selected may depend, in part, on limitations of the machinery to be used in bending the sheet metal and characteristics of the metal. For example, certain machines cannot bend metal into continuous arcs. Accordingly, arcuate design portions may be approximated by a series of chord-like flat segments. Of course, the foregoing standards are only exemplary. Any formats can be utilized and interfaced with the controller 70.

In order to more accurately fit the channel 16 to the front 14 and back 12 plates of the housing, the plates 12 and 14 and channel 16 may be designed using the curve generating method set forth in U.S. application Ser. No. 08/291,444, which is incorporated herein by reference. The method as set forth in that application allows a designer to design curves that are comprised entirely of line and circular arc segments that can be directly implemented by standard computer numeric controlled machinery, thereby eliminating errors that may be introduced in the process of translating the desired design for machine implementation.

The controller 70 is also operative for determining a sequence for making the bends based on certain bending criteria. Such bending criteria may account for a number of factors. First, the sequence for making the bends is selected to avoid mechanical interference between portions of the workpiece 24. As set forth in U.S. Pat. No. 5,377,516, the process for determining a feasible sequence for making the bends is generally an iterative process of selecting a candidate bend, determining whether the bend can be made without interference, and selectively assigning the bend a sequence number or selecting a new candidate bend until all bends have been assigned a sequence number. A similar iterative process can be employed to ensure that the workpiece 24 is retained within the working area of the bending machine 30 throughout the bending operation.

Other design criteria that may be factored into the process for determining the bending operation include, for example, minimizing the time and energy requirements for forming the design. In this regard, it will be appreciated that it will normally be preferred to form the bend at or near the origin, rather than at a remote location within the bending area so as to minimize gantry movement. However, with respect to particularly rigid or thick workpieces 24, it may be preferable to initiate a bend at a position remote from clamping devices 44 and work towards the origin to thereby utilize the length of the workpiece as a movement arm to reduce the force required to implement the desired bend. Accordingly, the controller 70 may also determine optimal locations for contact between the bending tools and the workpiece which may not correspond to the location of the bend. Such factors may be considered in conjunction with the feasibility determinations discussed above in determining an optimal bending process.

In implementing this process, it has been found that the computational complexity can be significantly reduced by determining the bending sequence in backwards order and then reversing the order for implementation. That is, in determining the bending sequence, the controller 70 assumes the desired final shape as a starting point. From the final shape, the controller works backwards by straightening bends and retracting an imaginary workpiece 24 through the origin into the IPM 34, while considering the above-referenced design criteria. Consequently, the controller 70 determines a sequence for taking a selected end design, straightening the design, and retracting the imaginary workpiece 24 into the IPM 34 while monitoring the operation to ensure that the workpiece 24 stays within the bending area of the bending machine 30, that mechanical interference between portions of the workpiece 24 is avoided, and that a coordinate of the workpiece 24 is always at the origin, all while minimizing the time and energy required for the process. The backwards sequence thus determined is reversed for implementation. The process is reversible and the optimized backward sequence will result in an optimal forward sequence for forming the desired shape.

The bending information thereby determined is translated by the controller 70 into control instructions for operating the bending tools of the various bending tables. Each of the bending tools of the various bending tables can be driven to any desired location along any desired curve by breaking the desired motion into linear components that can be implemented by the various drive motors. By driving the bending tools in a coordinated manner, a variety of corners, arcs and complex curves can be formed at various locations of the bending area. Moreover, these bends can be formed out-of-sequence as may be desired.

While various embodiments of the present invention have been described in detail, it is apparent that further modifications and adaptations of the invention will occur to those skilled in the art. However, it is to be expressly understood that such modifications and adaptations are within the spirit and scope of the present invention. For example, illustrations and descriptions of the disclosed embodiments have been made in the general context of a cartesian coordinate system where the work surface and workpiece are positioned in a vertical orientation relative to ground. It should be understood that the present invention can be operated in any spatial orientation.

What is claimed is:

1. An apparatus for bending a workpiece, comprising:

a first bending element for use in bending said workpiece;

a second bending element for use in cooperation with said first bending element in bending said workpiece;

first positioning means for positioning said first bending element, said first positioning means operative for moving said first bending element relative to a first axis and relative to a second axis transverse to said first axis so as to provide at least two-dimensional positioning of said first bending element; and second positioning means for positioning said second bending element, said second positioning means operative for moving said second bending element relative to said first axis and relative to said second axis so as to provide at least two-dimensional positioning of said second bending element;

wherein said first and second positioning means define an operating region such that a bending operation can be performed on said workpiece at a selected location within said operating region and said first and second bending elements can cooperate to form a single bend in the workpiece.

2. The apparatus of claim 1, wherein said first bending element comprises a first roller, a second roller, and roller positioning, means for selectively positioning said first or second roller in a bending position to interact with the workpiece.

3. The apparatus of claim 2, wherein said first and second rollers are mounted on a moveable support and said roller positioning means comprises means for interchangeably positioning one of said first or second rollers in a bending position.

4. The apparatus of claim 1, wherein each of said first and second bending elements comprises a rotatable roller.

5. The apparatus of claim 1, wherein one of said first or second bending elements comprises a clamp for fixedly engaging said workpiece during said bending operation.

6. The apparatus of claim 5, wherein said first and second positioning means position said first and second bending elements on the same side of said clamp.

7. The apparatus of claim 1, wherein said first positioning means is operative for positioning said first bending element relative to a third axis transverse to said first and second axes.

8. The apparatus of claim 1, wherein said first and second positioning means are independently operable to provide relative movement between said first and second bending elements.

9. The apparatus of claim 1, wherein said first positioning means is disposed on a first side of said operating region and said second positioning means is disposed on a second side of said operating region opposite said first side.

10. The apparatus of claim 1, further comprising advancement means for advancing said workpiece to a selected location within said operating region.

11. The apparatus of claim 9, further comprising sensing means, disposed in predetermined relation to said advancement means, for reading encoded information regarding said workpiece.

12. The apparatus of claim 11, wherein said encoded information comprises instructions for processing said workpiece.

13. The apparatus of claim 1, further comprising feedback means, associated with said first bending member, for providing feedback information regarding one of a position and a shape of said workpiece.

14. The apparatus of claim 13, wherein said feedback means comprises sensor means for providing feedback information regarding one of a position and a shape of said workpiece and pattern recognition means for employing said feedback information together with stored pattern information to determine a location for said bending operation.

15. The apparatus of claim 13, wherein said feedback means comprises means for determining an attitude of one of said first and second positioning means for addressing said workpiece to perform said bending operation.

16. The apparatus of claim 1, further comprising controller means operatively associated with said first and second positioning means, for receiving design commands regarding a desired design for said workpiece and providing bending information for forming said desired design.

17. The apparatus of claim 16, wherein said controller means comprises means for determining bending information for forming a bend of said desired design, said bending information including one of a position or a shape of said bend.

18. The apparatus of claim 17, wherein said bending information comprises a sequence for forming a series of bends of said design.

19. The apparatus of claim 1, wherein said second positioning means is operative for positioning said second bending element relative to a third axis transverse to said first and second axes.

20. A method for use in forming a workpiece into a desired design, comprising the steps of:

determining a sequence of bends for forming said workpiece into said desired design;

positioning said workpiece in a selected bending region;

providing at least one bending tool which is positionable relative to said bending region by operating a tool positioning system;

first forming a first bend of said sequence of bends by operating said positioning mechanism to position said bending tool at a first location relative to said bending region;

second forming a second bend of said sequence of bends by operating said positioning mechanism to position said bending tool at a second location relative to said bending region; and holding at least a portion of said workpiece in a fixed position relative to said bending region from a first time of said step of first forming to a second time of said step of second forming.

21. The method of claim 20, wherein said step of determining comprises operating a processor to determine a time sequence for bending operations which is free from mechanical interference between portions of said workpiece.

22. A method for use in forming bends in a workpiece, comprising the steps of:

determining a series of bends for forming said workpiece into a desired design, said series including a first bend, a second bend and a third bend wherein said second bend is located between said first bend and said third bend relative to a length of said workpiece;

providing at least one bending tool which is positionable relative to said bending region by operating a positioning mechanism;

first operating said positioning mechanism to position said bending tool at a first location at a first time for forming said first bend;

second operating said positioning mechanism to position said bending tool at a second location at a second time for forming said second bend; and third operating said positioning mechanism to position said bending tool at a third location at a third time for forming said third bend, said third formed bend being physically located between said first formed bend and said second formed bend;

wherein said series of bends are formed in a sequence different from the sequence of bends as ordered on the workpiece.

23. A method for use in operating a bending machine for bending a workpiece to form a desired design, said design including a plurality of bends, the method comprising the steps of:

determining a completed shape of said desired design including said plurality of bends;

selecting design criteria relative to a process for bending said workpiece to form said desired design;

analyzing a potential operation for straightening one of said bends relative to said selected bending criteria;

repeating said step of analyzing to derive a backward sequence for forming a straightened workpiece beginning from said desired design in accordance with said selected bending criteria;

reversing said backward sequence to obtain a forward sequence for forming said workpiece into said desired design in accordance with said design criteria; and operating said bending machine to form said bends in said workpiece in said forward sequence.

24. The method of claim 23, wherein said bending criteria comprises avoiding mechanical interference between separate portions of said workpiece.

25. The method of claim 23, wherein said bending machine includes a bending region for operating on said workpiece, and said bending criteria comprises maintaining said workpiece within said bending region.

26. The method of claim 23, wherein said bending machine includes a bending region and an origin for advancing said workpiece into said bending region, and said bending criteria comprises moving said workpiece through said origin in connection with forming said bends.

27. An apparatus for bending a workpiece, comprising:

a first bending element for use in bending said workpiece;

a second bending element for use in cooperation with said first bending element in bending said workpiece;

first positioning means for positioning said first bending element, said first positioning means operative for moving said first bending element relative to a first axis, relative to a second axis transverse to said first axis and relative to a third axis transverse to said first and second axes so as to provide at least two-dimensional positioning of said first bending element; and second positioning means for positioning said second bending element, said second positioning means operative for moving said second bending element relative to said first axis and relative to said second axis so as to provide at least two-dimensional positioning of said second bending element;

wherein said first and second positioning means define an operating region such that a bending operation can be performed on said workpiece at a selected location within said operating region.

* * * * *